US005842897A

United States Patent [19]

Jeong et al.

[11] Patent Number: 5,842,897

[45] Date of Patent: Dec. 1, 1998

[54] SPACERS FOR FIELD EMISSION DISPLAY AND THEIR FABRICATION METHOD

[75] Inventors: Hyo Soo Jeong, Seoul; Young Rae Cho; Jae Yeol Oh, both of Kyonggi-Do, all of Rep. of Korea

[73] Assignee: Institute for Advanced Engineering, Seoul, Rep. of Korea

[21] Appl. No.: 603,299

[22] Filed: Feb. 20, 1996

[30] Foreign Application Priority Data

Feb. 28, 1995 [KR] Rep. of Korea ..... 95-4079
Mar. 3, 1995 [KR] Rep. of Korea ..... 95-4305

[51] Int. Cl.[6] ..... H01J 9/24
[52] U.S. Cl. ..... 445/24
[58] Field of Search ..... 445/24, 25

[56] References Cited

U.S. PATENT DOCUMENTS 2,933,648 4/1960 Bentley ..... 445/25
5,413,513 5/1995 Horne et al. ..... 445/24
5,503,582 4/1996 Cathey, Jr. et al. ..... 445/24

FOREIGN PATENT DOCUMENTS 277439 10/1992 Japan ..... 445/24

OTHER PUBLICATIONS

FOTOFORM: A Material and a Capability; a Corning Advertising Brochure, Date Unknown.

*Primary Examiner*—Kenneth J. Ramsey
*Attorney, Agent, or Firm*—Jacobson, Price, Holman & Stern, PLLC

[57] ABSTRACT

The invention is to provide the method for fabricating the spacers which are mechanically strong and have lower outgassing rate. Spacers in this invention are made of photosensitive glass. A net shaped photosensitive glass is etched by a first photolithography process and then the side wall of it is etched again by a second photolithography process for improving the efficiency of evacuation of the internal cavity of an FED.

8 Claims, 4 Drawing Sheets

SPACERS FOR FIELD EMISSION DISPLAY AND THEIR FABRICATION METHOD

FIELD OF THE INVENTION

This invention relates to a field emission cathode based flat panel display, more particularly, the formation of photosensitive glass spacers between an emitter array and the display face of such a panel, and the resulting structure.

BACKGROUND OF THE INVENTION

Cathode ray tubes (CRTs) are widely used to display monitors for television sets, computers and other visually display information. This wide use is owing to the favorable quality of color, brightness, contrast and resolution which are achievable with cathode ray tubes. Conventional CRTS, however, have the disadvantage that they need significant space behind the actual display screen, making them large and cumbersome.

Flat panel displays draw significant interests in many situations where the volume associated with conventional cathode ray tube displays (CRTs) is a major disadvantage such as portable computers and television sets, and head mounted displays. Flat panel displays have the advantage of relying on the well developed cathodoluminescent phosphor approach of CRTs while providing a particularly thin, simple and high resolution display formed in large part by techniques used to form integrated circuit.

The concept of field emission displays (FEDs), one of flat panel displays, emerged late 1960s. Electrons are ejected from cathodes by a principle of quantum mechanical tunneling when an electric field applied rather than boiling out the electron by heat like in CRTs. The FED comprises of cathode electrodes addressed in matrix form, gate electrodes which controls the emission currents, anode electrodes coated with cathodoluminescent phosphor on one side opposing the cathode and spacers which maintain the spacing between cathode and anode electrodes uniform. The FED has several advantages over the other displays. First, as cathode electrodes and gate electrodes can be formed on the same substrate, the structure of it is simple. Second, it has low electric power consumption than other displays, considering the fact that it uses cold cathodes. Finally as it is self emissive, it fulfills the condition for the next generation flat panel displays that they should have high brightness and contrast.

It is important that the electron emitting surface and the opposed display face be maintained insulated from one another throughout the full extent of the display face. Also the cathode-to-anode-gap should be made as small as possible to reduce the required voltage to operate the FED and the spacing has to be uniform for uniform resolution, brightness, to avoid display distortion, etc. In addition, for the emitted electrons to travel freely through the volume surrounding the FED and impinge upon an image face plate, to prevent the electrical break down and to keep from any attack by the ionized gas molecules under the high potential near the cathode, it is necessary to maintain high vacuum, typically less than $1\times10^{-5}$ torr, in the FED. As the pressure differential between the lower pressure in the FED, and the outer atmospheric pressure cause load on the base and face plates of the FED it is necessary to form spacers inbetween face and base plates to withstand the load.

In a known method for fabricating spacers of a known FED according to one instance of prior arts, spacers are made of polymers, and after forming spacers having a constant thickness on emitters or on phosphor surfaces by using a spin-coating method, an etching process of the spacers is performed. However, during performing the etching process, some problems may occur such that the emitters and/or the phosphors may be damaged and polymers should be used in a re-plasticized state at a constant temperature.

Also, when forming desired spacers through the etching process after coating polymer solutions by way of the spin-coating method mentioned above, the degree of uniformity of the heights of the spacers is not good and polymers may be changed in their nature during firing process at a high temperature. In addition, another problem in a prior art is that some polymer spacers are not adequate for high-vacuum devices because severe outgassing may occur when exhausting gases to attain such a very high-vacuum state.

A screen-printing method is known as another method for fabricating spacers of an FED in prior art. According to the screen-printing method, spacers have some limitation on height and width because the spacers can be fabricated only in one direction. More specifically, in the known screen-printing method, the height of spacers obtained from one printing process is limited. If performing the printing process in several times, then stackaging the spacers with a constant width is substantially impossible due to a problem of an alignment. Furthermore, there is another problem in the method that a base plate may be damaged because firing the spacers requires a high temperature.

As an alternative prior art to solve the problem discussed above, some methods for fabricating spacers by using polymers such as polyamide for their material is disclosed in detail in U.S. Pat. Nos. 4,923,421 and 5,063,327. However, even in those methods, there is a problem that an exhaustion of gases in order to evacuate an internal space of a known FED device into a vacuum state is not easy.

SUMMARY OF THE INVENTION

Spacers must be used in an FED for withstanding the load caused by the pressure differential between the outer atmospheric pressure and pressure of the internal cavity of an FED. The spacers must be mechanically stable and have lower outgassing rate not to degrade the vacuum level of an FED. Therefore selection of spacers which should be strong enough to withstand the above mentioned load and have little effect on the high vacuum inside an FED is very important.

Photosensitive glasses are used as spaces for an FED in this invention. First, in a first photolithography process net shaped spacers are formed by etching away some parts of the glass which area is corresponding to pixels. If the net shaped photosensitive glass after etching is inserted between the face plate and the base plate, there arises a difficulty in exhausting the gas residing in the FED because the walls of the etched glass between pixels hinder the movement of gas molecules. The above mentioned problem can be solved by dissolving secondly other parts of photosensitive glass remaining inbetween the pixels and as a result it is possible to fabricate spacers which are mechanically stable and increase the efficiency of the evacuation of the internal space of an FED.

BRIEF DESCRIPTION OF THE DRAWINGS

The present invention will be better understood from reading the following description of non-limitive embodiments, with reference to the attached drawings, wherein below.

DETAILED DESCRIPTION OF THE INVENTION

Figure 1:
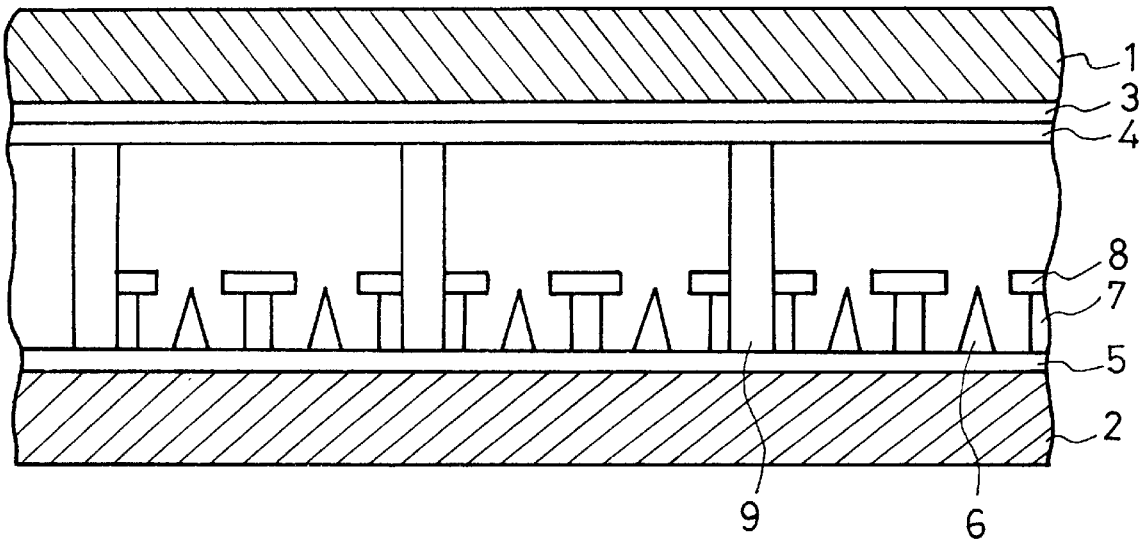
FIG. 1 is a cross-sectional view of a conventional FED according to prior art.

Referring to FIG. 1, a cross-section of a conventional FED according to prior art is depicted. As depicted in FIG. 1 a known FED has a face plate 1 and a base plate 2 which is placed opposite to the face plate 1. Phosphors with red, blue, and green colors are evaporated on the anode electrode 3. The anode electrode 3 is made of indium-tin-oxide (ITO) which is a transparent conductive material. The base plate 2 is made of glass or silicon wafer, etc. A cathode electrode 5 is formed on the base plate 2. The cathode electrode 5 on which emitters are fabricated is made of a semiconductor or a conductive metal. There are two kinds of emitters according to the shape; one is tip type emitters and the other is thin film type emitters. In the case of emitter tips, the emitter tips 6 can be fabricated from a silicon wafer, in a manner of performing etching, evaporating and plasma processes of the silicon wafer. Emitters are isolated from one another by evaporated dielectric layers 7. And thereafter, gate electrodes 8 are formed on the dielectric layers 7 by evaporating a conductive material.

Spacers 9 with a length ranging approximately from 20 to 300 $\mu$m are formed between the face plate 1 and the base plate 2. The spacers should have sufficient strength to withstand the load caused by pressure differential between the outer atmospheric pressure and the internal pressure of an FED, and should have lower outgassing rate.

The next process is to coat each edge of the baseplate 2 and the spacers 9 with a sealing material such as sealant and to seal off the edges, after aligning the face plate 1, the base plate 2 and the spacers 9 exactly. After that, although not shown herein, holes are formed near the edges of the base plate 2 and small tubes are connected to the holes. A very high-vacuum state in an internal space of the FED fabricated by the above method is obtained by operating a vacuum pump. As mentioned in the previous section, spacers must act as supporters to withstand the load caused by the pressure differential. Also it must have a lower outgassing rate not to degrade the high vacuum level of the FED panel. However it is difficult to form and align spacers which are strong enough to stand the load and have a uniform height by using a conventional method because the gap between the face and base plates is too small.

Figure 2:
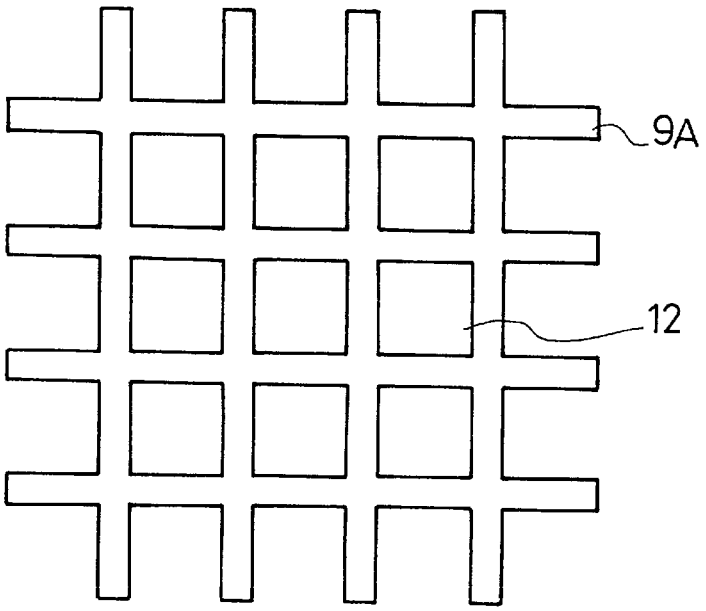
FIG. 2 is a top view of net shaped spacers of an FED according to an embodiment of the present invention, after performing a first etching process of the spacers using a first mask.

FIG. 2 is a top view of spacers of an FED according to an embodiment of the present invention, after performing a first etching process of the spacers using a first mask. The spacers 9A are made of photosensitive glass 9 which is photoetchable. Photosensitive glass has the main component of $Li_2O/SiO_2$ with an additional small amount of ceramic and silver. Positions and sizes of the holes of the first mask must be designed for the emitted electrons from the cathode not to be hindered in its movement to phosphor layer on the anode electrode. Some area which is exposed to ultraviolet rays become crystallized whereas unexposed part of the glass remains amorphous. As the crystallized photosensitive glass is etched faster by ten times with the etchant having the HF as a major component than the part which is not crystallized, the exposed area through the hole in the first mask can be etched selectively. Using the above mentioned method, some photosensitive glass coated with photoresistive layer can be selectively etched as well.

As shown in FIG. 2, the etched photosensitive glass has holes 12 which are corresponding to pixels. By placing the etched glass, which act as spacers, between the face plate and base plate, it is possible to fabricate an FED which is mechanically strong and has no cross talk in its operation. However, as each etched photosensitive portion 12 which is etched away and is corresponding to pixels are isolated from one another by the face and, base plates and its side walls 9A, and remains as isolated space, it is difficult to evacuate the whole cavity of FED after sealing. Therefore it is needed to make some paths for gas molecules to escape during evacuation.

Figure 3:
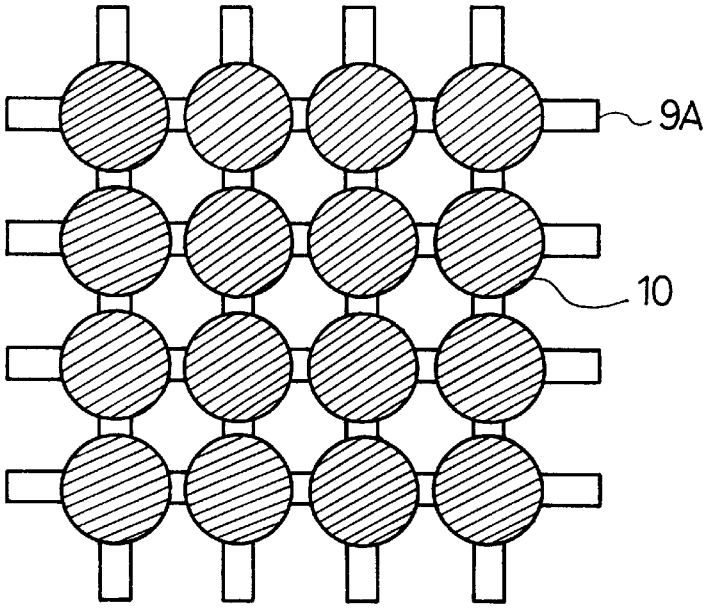
FIG. 3 is a schematic diagram showing a second mask placed on the first etched photosensitive glass.

FIG. 3 is a schematic diagram depicting the second mask on the etched photosensitive glass. The underlined part 10 in FIG. 3 shows the area where ultraviolet rays can not penetrate. In a second etching process the etched depth must be smaller than the thickness of the glass and it is preferable to etch the glass down to ¼ or ¾ of the total thickness of the glass. The etched depth of glass can be controlled by changing input energy of ultraviolet rays or process parameters. In this process, if the glass is etched too severely, it is difficult to handle the etched glass whereas, when the glass is etched too slightly, it is difficult to evacuate the cavity of the panel in the packaging process. Although an instance was shown in FIG. 3 that all the area except circular part is exposed to ultraviolet rays using a second mask any shape of the second mask can be used for etching.

Figure 4:
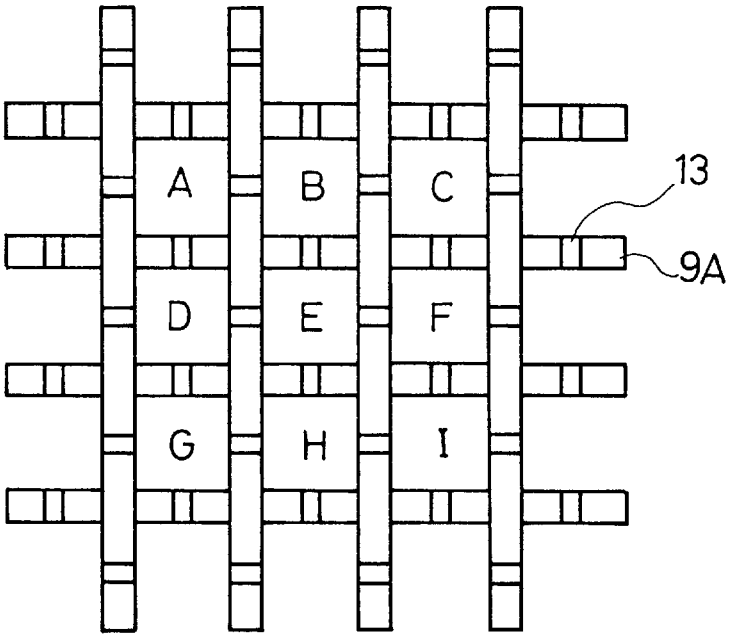
FIG. 4 is a schematic diagram showing the relation between the positions of the pixels and etched photosensitive glass by using the second mask.

FIG. 4 is a schematic diagram showing the relation between the positions of secondly etched photosensitive glass and pixels. Some areas from "A" to "I" in the figure area etched portions corresponding to pixels using the first mask. As shown in FIG. 4, it is easily seen that the secondly etched area render the movement of gas more easier. For example, gases residing in "E" can move without difficulty to the neighboring "B, F, H, G" areas through the area 13 which is formed using the second mask in the second photolithography process.

Figure 5:
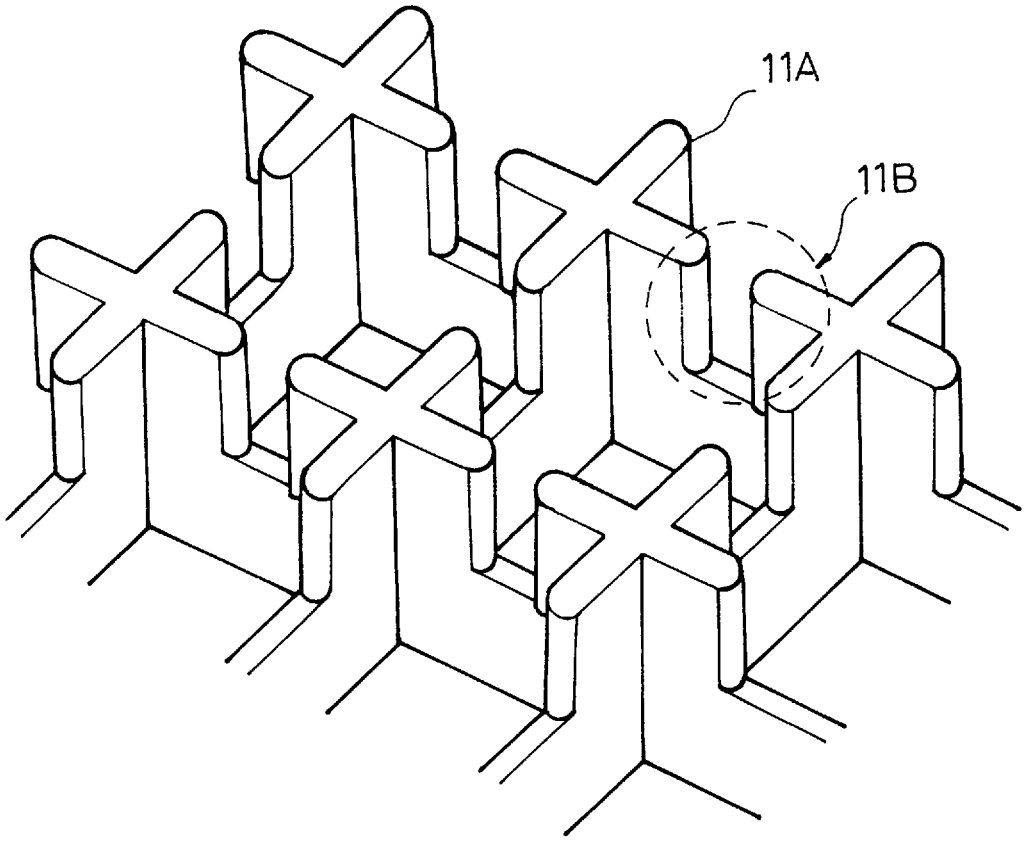
FIG. 5 is a prospective view depicting in detail a final structure of spacers according to the present invention.

FIG. 5 is a prospective view depicting the final structure of spacers fabricated using this invention. As shown in this figure, as the unit cell of wall of the net shaped spacers fabricated using the present invention have the shape of cross 11A in some part and the shape of "U" 11B in other part, the evacuation rate is faster than that of the structure depicted in FIG. 4 and the spacers are mechanically stronger than other polymer spacers. Cross shaped part 11A of the spacers being inserted between the two plates make the spacing uniform. In this case the cross shaped portion of the spacers have the height which is the same size as the thickness of the photosensitive glass. Selection of the thickness of the spacers to be used depends on the type of emitters; spacers of 150 $\mu$m are used for emitter tip type FED and spacers of 30 $\mu$m is used for the thin film type FED.

As described in detail above, the present invention make it possible to fabricate spacers having higher strength with lower outgassing rate in a lower price than by the prior arts.

While FEDs having particular spacers and their fabricating method herein disclosed and shown in detail are fully capable of obtaining their objects and advantages. It is to be understood that it is merely illustrative of the presently preferred embodiments of the details of structures or design or method herein shown other than described in the appended claims.

What is claimed is:

1. A method for fabricating a field emission display comprising the following steps:

evaporating a transparent electrode on the lower part of a face plate, making said transparent electrode in a desired pattern, and coating a phosphor on said transparent electrode;

forming in sequence a base plate opposite to said face plate, a cathode electrode on said base plate, emitter tips on said cathode electrode, dielectric layers on said cathode electrode and gate electrodes on said dielectric layers;

forming net shaped photosensitive spacers using a first mask by a first lithography process;

etching side walls of the first etched photosensitive glass by a second photolithography process, thereby forming the net shaped spacers being consisted of cross-shaped parts and U-shaped parts;

aligning said face pate, said base plate and said spacers; and firing sealant material after coating said sealant material around edges of said face plate and said base plate.

2. The method for fabricating a field emission display according to claim 1 wherein said photosensitive glass has the main component of $Li_2O/SiO_2$ with a small amount of additions.

3. The method for fabricating a field emission display according to claim 1 wherein said photosensitive glass have the thicknesses ranging from 30 $\mu$m to 300 $\mu$m.

4. The method for fabricating a field emission display according to claim 1, further comprising a step of forming a plurality of pixels at etched holes after the first lithography process of the forming step.

5. The method for fabricating a field emission display according to claim 1 wherein said etched holes of said etched area is corresponding to pixels.

6. The method for fabricating a field emission display according to claim 1 wherein said wall of photosensitive glass is etched down to ¼ or ¾ of the thickness of photosensitive glass.

7. The method for fabricating a field emission display according to claim 1, wherein source for the first and second photolithography process is ultraviolet rays.

8. The method for fabricating a field emission display according to claim 1, wherein an etching solution for the first and second photolithography process includes HF in its composition.

* * * * *